US007347066B1

(12) United States Patent
Feuer

(10) Patent No.: US 7,347,066 B1
(45) Date of Patent: Mar. 25, 2008

(54) CONVERTIBLE JEWELRY CONSTRUCTION

(76) Inventor: Jeffrey Feuer, c/o Schweitzer Cornman Gross & Bondell LLP, 292 Madison Ave., 19th Floor, New York, NY (US) 10017

( * ) Notice: Subject to any disclaimer, the term of this patent is extended or adjusted under 35 U.S.C. 154(b) by 112 days.

(21) Appl. No.: 11/312,671

(22) Filed: Dec. 19, 2005

(51) Int. Cl.
*A44C 7/00* (2006.01)
*A44C 9/00* (2006.01)

(52) U.S. Cl. ..... 63/12; 63/1.16; 63/3; 63/14.1; 63/15

(58) Field of Classification Search ..... 63/1.11, 63/1.16, 1.17, 1.18, 12, 13, 3, 3.1, 3.2, 5.1, 63/6, 7, 9, 15, 15.45, 15.65, 15.7, 33, 41
See application file for complete search history.

(56) References Cited

U.S. PATENT DOCUMENTS 257,732 A * 5/1882 Leon ..... 63/41
271,121 A * 1/1883 Riley et al. ..... 63/12
498,648 A * 5/1893 Gumbart ..... 63/1.16
3,221,514 A * 12/1965 Newman ..... 63/15.7
4,291,551 A * 9/1981 Levine ..... 63/12
6,128,923 A * 10/2000 Brams ..... 63/12

* cited by examiner

*Primary Examiner*—Katherine Mitchell
*Assistant Examiner*—Ruth C. Rodriguez
(74) *Attorney, Agent, or Firm*—Schweitzer Cornman Gross & Bondell LLP

(57) ABSTRACT

A jewelry item has dual functions, such as an earring and a ring or bracelet. The item includes a main loop-like main body portion having opposed first and second ends. First and second hinge elements are pivotally joined to the ends, and are independently pivotable. With the first and second hinge elements in a closed position, joining the ends, the jewelry item serves a first function, such as a ring. With the first hinge element in an open position and the second hinge element in the closed position, the item serves a second function, such as an earring.

12 Claims, 4 Drawing Sheets

CONVERTIBLE JEWELRY CONSTRUCTION

The present invention relates to an item of jewelry, and particularly to such an item which is convertible between alternative forms, such as a ring and an earring or a bracelet and an earring.

BACKGROUND OF THE INVENTION

People have long been wearing jewelry items as a form of personal adornment and expression. Conventional jewelry items are constructed to be worn on a particular part of the body, whether on the ear as an earring, on a finger or toe as a ring, around the arm as a bracelet, etc. Thus, the wearer must provide him or herself with a variety of jewelry items to provide the desired adornment for the various parts of the body. Such jewelry collections can be extensive, and given the materials from which jewelry is often constructed, namely precious metals and gems, the amassing of such a collection can be an extensive and costly undertaking.

It is accordingly a purpose of the present invention to provide a jewelry construction which allows a single item of jewelry to function as and to be worn in two alternative forms, such as a ring or an earring or as a bracelet or an earring.

A further purpose of the present invention is to provide such a construction which may be easily converted from a first form to a second form, such conversion being able to be performed by the wearer of the jewelry item and without recourse to specialized tools.

Yet a further purpose of the present invention is to provide such a convertible jewelry construction in a form that does not meaningfully detract from the appearance of the jewelry item, and allows the jewelry item to otherwise maintain a generally conventional appearance when worn in either of the alternative forms.

BRIEF DESCRIPTION OF THE INVENTION

In accordance with the foregoing and other objects and purposes, a jewelry item constructed in accordance with the present invention constitutes a generally circular item of jewelry, and particularly an earring, which also can be worn as another jewelry item, such as a ring or bracelet. In accordance therewith, the jewelry item has a main body element, formed as an open loop-like construction, having first and second spaced ends. A first hinge element is affixed to at least one of the ends and is pivotally mounted with respect thereto, such that in a closing orientation it spans and bridges the opening between the ends. The hinge element is preferably further dimensioned to provide an appearance which is substantially compatible with the appearance of the remaining portion of the jewelry item such that, when in the closing orientation, the jewelry item substantially mimics the appearance of a solid, closed loop and then may be appropriately worn as a ring or bracelet. The hinge element is further preferably dimensioned such that, when in an open position, it folds back substantially towards a surface of the main body element. A second hinge element is similarly pivotally mounted to one of the loop ends, also spanning the opening to provide an alternative closed loop construction. The second hinge element is chosen to be of a construction appropriate for an earring hook, and preferably is in the form of a wire, whereby the jewelry item can be used as an earring with the wire supporting the jewelry item on the ear in a well-known manner. The first hinge element may be provided with an aperture or recess into which the second hinge element fits when the first hinge is in the closing orientation, such that the second hinge element is generally concealed and/or made less apparent to a casual observer.

BRIEF DESCRIPTION OF THE DRAWINGS

A fuller understanding of the present invention will be obtained upon consideration of the following detailed description of preferred, but nonetheless illustrative embodiments of the invention, when reviewed in association with the annexed drawings, wherein.

DETAILED DESCRIPTION OF THE INVENTION

Figure 1:
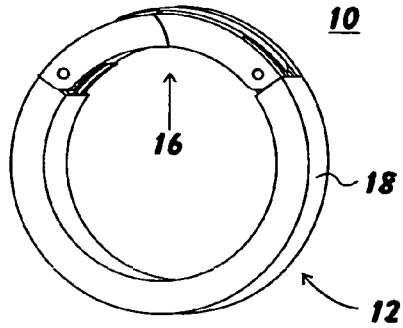
FIG. 1 is a perspective view of a jewelry item of the invention in a configuration to be worn as a ring.
Figure 2:
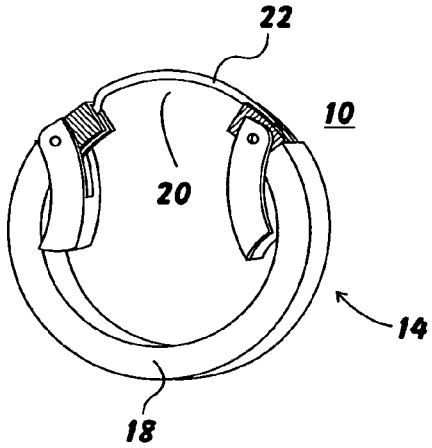
FIG. 2 is a perspective view showing the item of FIG. 1 as an earring.
Figure 3:
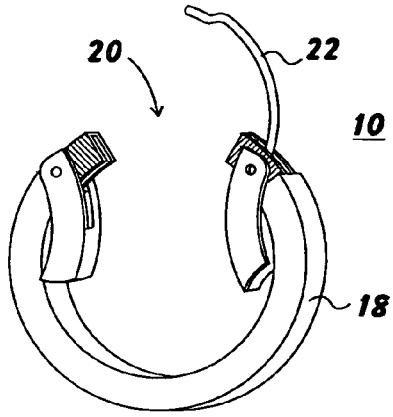
FIG. 3 is a perspective view of the invention illustrating the earring configuration for mounting on the ear.

With initial reference to FIGS. 1-3, jewelry construction 10 is convertible from a first configuration, represented as ring 12 in FIG. 1, into earring 14 as depicted in FIG. 2. When in the ring configuration, first hinge element 16 extends across the gap or opening 20 between the ends of the open loop main body element 18 and inter-engage and lock to form a ring of generally consistent dimensions as shown in FIG. 1. To convert the construction to an earring, the first hinge element 16 is folded down and back, towards the inner surface of the main body 18, exposing second hinge element 22. Second hinge element 22 may be in the form of a wire, allowing the jewelry item to be attached to an earlobe in the manner of a conventional pierced-ear earring. The earring being affixed to the ear and the wire then being again engaged with the receiving end of the main jewelry body as depicted in FIG. 2.

Figure 4:
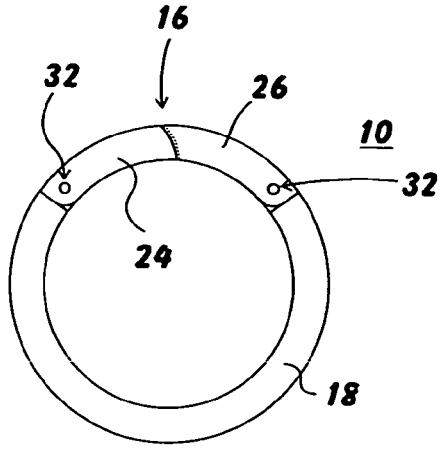
FIG. 4 is a front elevation view of the ring configuration.
Figure 5:
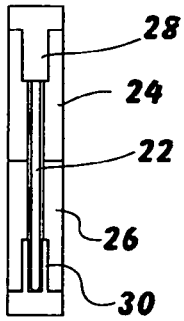
FIG. 5 is a top plan view thereof.
Figure 6:
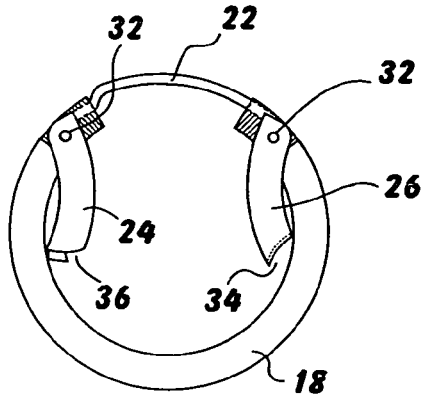
FIG. 6 is an elevation view of the earring configuration.

With further reference to FIGS. 4 and 5, first hinge element 16 may comprise a pair of mating elements 24, 26 pivotally mounted to the opposed end portions 28, 30 of main jewelry body element 18 by hinge pins 32. As seen in FIG. 5, the end portions 28, 30 may be of reduced width with respect to the remaining portion of the main jewelry body element 18, forming mounting flanges for the first hinge elements 24, 26. Both the thickness and width of the hinge elements 24, 26 are preferably chosen to compliment the width and thickness of the main jewelry body element 18, such that when closed, the hinge elements and the main jewelry body present a generally unitary and continuous construction.

As detailed in FIGS. 5-8, the distal ends 34, 36 of the first hinge elements are contoured and provided with complimentary means to allow them to be maintained in the joined and engaged position. As seen therein, distal end 36 may be provided with a projecting latch 38, while distal end 34 is provided with a corresponding opening 40 having a lower edge 42 with which the latch gently engages. Hinge element 26, with latch opening 40, is first pivoted into the closing position, followed by the pivoting of hinge element 24, latch 38 engaging with the edge 42.

Figure 7A:
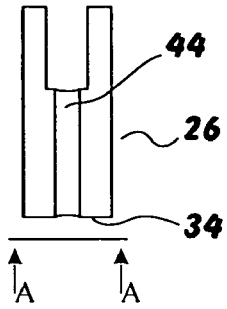
FIGS. 7A and 7B are plan views of the first hinge elements.
Figure 7B:
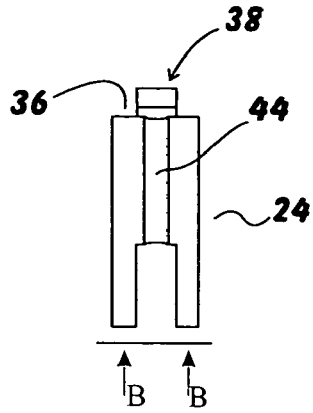
Figure 8A:
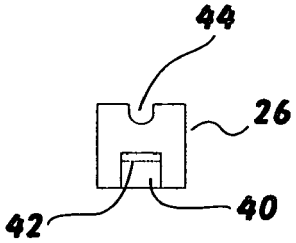
FIGS. 8A and 8B are elevation views of the first hinge elements taken along lines A-A and B-B in FIGS. 7A and 7B, respectively.
Figure 8B:
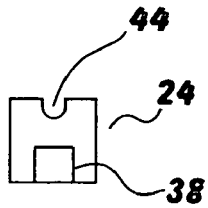
Figure 9:
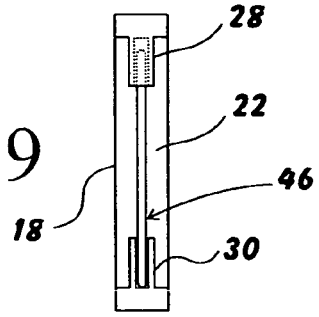
FIG. 9 is a top plan view showing the construction in the earring configuration, with the first hinge elements being deleted for clarity.
Figure 10:
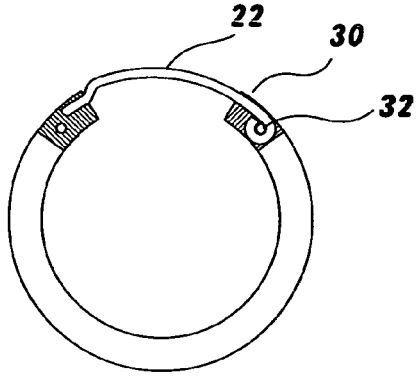
FIG. 10 is an elevation view of the earring configuration with the first hinge elements deleted.

As further best seen in FIGS. 7 and 8, each of the first hinge elements 24, 26 may be provided with a longitudinally-extending groove 44 on their top surfaces to receive and conceal the second hinge element. As further depicted in FIGS. 9 and 10, second hinge element 22 may be mounted to end portion 30 of main jewelry body 18 by the hinge pin 32, or alternatively may be mounted upon a separate hinge pin. As seen in FIG. 10, an end of the hinge element wire may be simply wound around the pin to provide a pivot connection therewith. As further depicted in FIG. 9, the end 30 of the main jewelry body is also provided with a slot in which the hinge wire is mounted and allows the wire to pivot between open and closing positions. The opposed end portion 28 of the main jewelry body has an entryway at its lower surface to accommodate the distal end of the wire.

Figure 11:
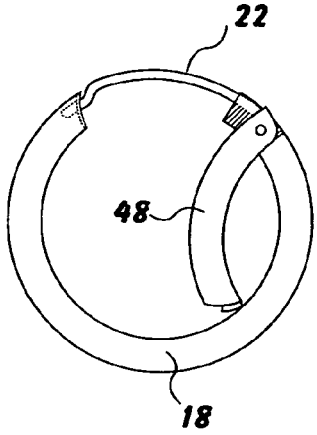
FIG. 11 is an elevation view of an alternative embodiment of the invention.

FIG. 11 depicts an alternative embodiment of the invention. As shown therein, the first hinge element is in the form of a single hinge 48, which spans the entire width of the opening 20 and may be provided with a locking mechanism (not shown) to engage it with the opposed end portion of the body portion. The second hinge element 22 is formed and mounted in the same manner as in the first embodiment.

As may be appreciated, the main body element 18 may take any appropriate shape and size for its intended use as a ring, bracelet or other jewelry item, so long as it terminates with an open area 20 to be bridged by the first and second hinge elements, and accordingly the term "loop" is intended to encompass any of such shapes, such as ovals or polygons, in which the main body portion constitutes a major portion thereof with exposed open ends. Both the main body element and the first hinge element may be adorned as appropriate with appropriate contouring and/or surface effects, including engraving, jewels, etc., as may be desired, the first hinge element when closed as depicted in FIG. 1 providing a continuous finished appearance about the entire periphery of the jewelry item.

I claim:

1. A jewelry item, comprising:

a main body element forming a major portion of a loop, and having spaced opposed first and second ends; and first and second hinge elements pivotally connected to the main body element and dimensioned to independently fully span and close the space between the first and second ends when in a closing orientation, whereby, with the first hinge element in the closing orientation the jewelry item is adapted to be worn on a first body portion and with the first hinge element in an open position and the second hinge element in the closing orientation the jewelry item is adapted to be worn on a second body portion that is different from the first body portion.

2. The jewelry item of claim 1, wherein the first hinge element has an open orientation in which it is in a position generally adjacent to a surface of the main body element.

3. The jewelry item of claim 2, wherein the main body element surface is an inner surface.

4. The jewelry item of claim 1 wherein the first and second hinge elements are substantially coplanar.

5. The jewelry item of claim 2 wherein the second hinge element is an earring wire.

6. The jewelry item of claim 2 wherein the first hinge element comprises a pair of inter-engaging elements, each of said inter-engaged elements is pivotally connected to an opposite one of the first and second ends.

7. The jewelry item of claim 2 wherein the first hinge element has a recess on a surface to accept the second hinge element when the first and second hinge elements are in the closing orientation.

8. The jewelry item of claim 7 wherein the second hinge element is an earring wire and the recess is on an outer surface of the first hinge element.

9. The jewelry item of claim 1 wherein the first and second hinge elements are pivotally connected to the main body element by pin means.

10. The jewelry item of claim 9 wherein the pin means is a singe pin supporting both the first and second hinge elements.

11. The jewelry item of claim 6 wherein the inter-engaging elements have complementary releasable locking means.

12. The jewelry item of claim 1 wherein the first hinge element has a thickness and width substantially equal to a thickness and width of the main body element.

* * * * *